US008328121B2

(12) United States Patent
Irino et al.

(10) Patent No.: US 8,328,121 B2
(45) Date of Patent: Dec. 11, 2012

(54) MULTIHOLE INJECTOR

(75) Inventors: Yusuke Irino, Hitachinaka (JP); Tohru Ishikawa, Kitaibaraki (JP); Yasuo Namaizawa, Naka (JP); Motoyuki Abe, Hitachinaka (JP); Atsushi Sekine, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 555 days.

(21) Appl. No.: 12/512,522

(22) Filed: Jul. 30, 2009

(65) Prior Publication Data

US 2010/0051727 A1 Mar. 4, 2010

(30) Foreign Application Priority Data

Aug. 27, 2008 (JP) ..... 2008-217634

(51) Int. Cl.
*F02M 61/00* (2006.01)

(52) U.S. Cl. ..... 239/533.12; 239/533.14

(58) Field of Classification Search ..... 239/533.12, 239/533.14, 533.2, 552, 584, 553.3
See application file for complete search history.

(56) References Cited

U.S. PATENT DOCUMENTS 6,616,072 B2 * 9/2003 Harata et al. ..... 239/533.12
7,017,839 B2 * 3/2006 Heyse ..... 239/533.12
7,032,566 B2 * 4/2006 Cavanagh et al. ..... 123/299
7,100,848 B2 * 9/2006 Kobayashi et al. ..... 239/596
2007/0057093 A1 3/2007 Gunji et al.
2009/0007411 A1 1/2009 Miyagawa et al.
2009/0025680 A1 1/2009 Kihara et al.

FOREIGN PATENT DOCUMENTS

DE 10 2006 000 243 A1 11/2006
JP 2004-218634 A 8/2004
JP 2007-77843 A 3/2007
JP 2007-231924 A 9/2007
JP 2008-101499 A 5/2008

OTHER PUBLICATIONS

Japanese Office Action dated with partial English language translation dated Feb. 1, 2011 (Seven (7) pages).
European Search Report dated Apr. 26, 2011 (Five (5) pages.

* cited by examiner

*Primary Examiner* — Davis Hwu
(74) *Attorney, Agent, or Firm* — Crowell & Moring LLP

(57) ABSTRACT

Each of the injection holes has an inclined angle with respect to a center line of an injection valve main body as well as the inclined angle of each of the injection holes is provided with a predetermined offset amount with respect to a target inclination angle of a center of gravity position of each of the injected fuel sprays. The predetermined offset amount is set based on a correction amount for correcting positional drift with respect to the target direction of the center of gravity position of the fuel spray.

6 Claims, 9 Drawing Sheets

(CONVERSION FROM CROSS SECTIONED SPRAY IMAGE TO BRIGHTNESS INFORMATION)

(CALCULATION OF GRAVITY CENTER POSITION ACCORDING TO PREDICTED DISTRIBUTION AREA)

RELATIONSHIP BETWEEN TARGET GRAVITY CENTER POSITION AND DRIFT AMOUNT IN X DIRECTION

RELATIONSHIP BETWEEN TARGET GRAVITY CENTER POSITION AND DRIFT AMOUNT IN Y DIRECTION

MEASUREMENT RESULT OF GRAVITY CENTER POSITION OF SPRAY OF CORRECTED PROTOTYPE

MULTIHOLE INJECTOR

CLAIM OF PRIORITY

The present application claims priority from Japanese application serial no. 2008-217634, filed on Aug. 27, 2008, the content of which is hereby incorporated by reference into this application.

FIELD OF THE INVENTION

The present invention relates to a fuel injection valve for an internal combustion engine and in particular relates to a multi hole injection type fuel injection valve that injects fuel in multiple directions from multi injection holes.

BACKGROUND ART

With regard to a fuel injection valve used for an internal combustion engine (hereinbelow, simply called as "engine") for an automobile, a multi hole injection type fuel injection valve that injects fuel from a plurality of orifices (multi hole nozzles) in multiple directions has become commercially practice (for example, as shown in patent document 1: JP-A-2007-77843). In particular, in an in-cylinder use multi hole injection type fuel injection valve that directly injects fuel into a cylinder (a combustion chamber) of an engine, it is necessary in order to obtain a desired combustion performance to realize a proper air fuel mixture in the cylinder by spraying fuel to proper positions in the cylinder.

In connection with a multi hole injection type fuel injection valve that is mounted on an in-cylinder injection type engine, the present inventors have confirmed through experiments that when respective orifices serving as injection holes are set in an inclined manner with respect to a center line of the fuel injection valve, an injected fuel spray drifts with respect to a desired direction (this very drifting phenomenon will be explained later in the section of "BEST MODES FOR CARRYING OUT THE INVENTION"). In particular, when the respective orifices are set with inclinations of 5°~50° with respect to the axis of the fuel injection valve, the inventors confirmed such tendency is increased. Such positional drift of the fuel spray affects to such as distribution and uniformity of the fuel spray in the cylinder that cause an adverse effect to an engine performance and an exhaust performance.

SUMMARY OF THE INVENTION

The present invention has been made in view of the above, and an object of the present invention is to provide a multi hole injection type fuel injection valve that permits, in a multi hole and multi direction injection type fuel injection valve, to spray fuel to an optimum position that contributes to enhance such as engine performance and exhaust performance.

The present invention is constituted fundamentally in the following manner.

In a fuel injection valve for an internal combustion engine having multi injection holes that inject fuel in multiple directions, each of the injection holes has an inclined angle with respect to a center line of an injection valve main body as well as the inclined angle of each of the injection holes is provided with a predetermined offset amount so that a center of gravity position of the injected fuel spray is oriented in a target direction. The predetermined offset amount is characterized by setting based on a correction amount for correcting positional drift with respect to the target direction of the center of gravity position of the fuel spray.

Advantages of the Invention

With the multi injection holes each having a predetermined offset amount, the fuel can be sprayed to an optimum position representing a target that contributes to enhance such as engine performance and exhaust performance.

DETAILED DESCRIPTION OF THE PREFERRED EMBODIMENTS

Figure 1:
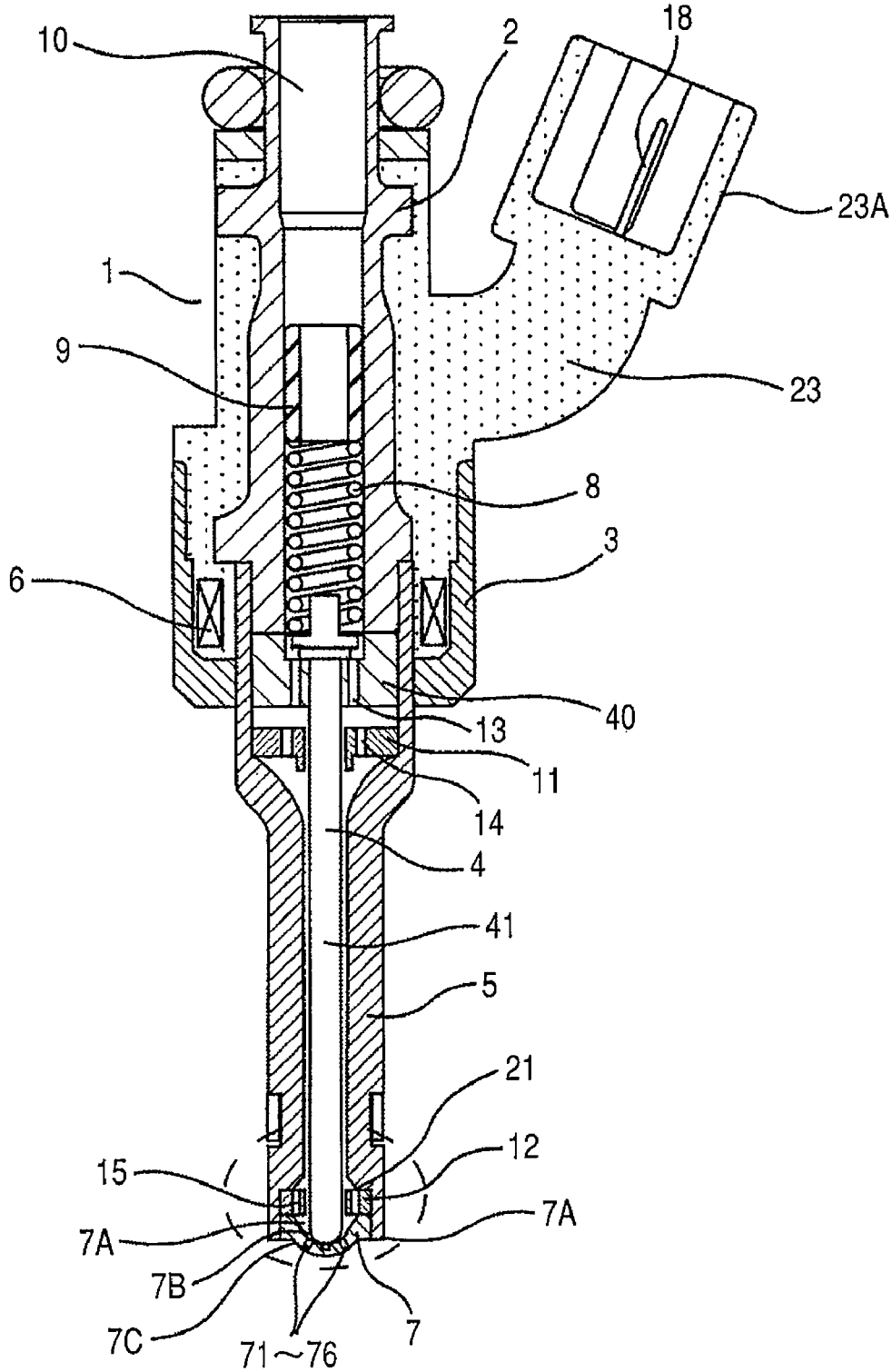
FIG. 1 is a longitudinal sectioned view showing an entire configuration of a fuel injection valve according to one embodiment of the present invention.

A preferred embodiment of the present invention will be explained with reference to an embodiment as shown in the drawings.

FIG. 1 is a longitudinal sectioned view showing an entire configuration of a fuel injection valve according to one embodiment of the present invention. The injection valve of the present embodiment is a fuel injection valve that directly injects fuel such as gasoline to a cylinder (a combustion chamber) of an engine.

An injection valve main body 1 includes a hollow stationary core 2, a yoke 3 serving as a housing, a movable body 4 and a nozzle body 5. The movable body 4 is constituted by a movable core 40 and a movable valve body 41. The stationary core 2, the yoke 3 and the movable core 4 function as constitutional elements for a magnetic circuit.

The yoke 3, the nozzle body 5 and the stationary core 2 are coupled by welding. Although such coupling can be performed in various ways, in the present embodiment, under a condition that a part of the inner circumference of the nozzle body 5 is fitted to a part of the outer circumference of the stationary core 2, the nozzle body 5 and the stationary core 2 are coupled by welding. Further, the nozzle body 5 and the yoke 3 are coupled by welding in such a manner that the yoke 3 surrounds a part of the outer circumference of the nozzle body 5. Inside the yoke 3, an electromagnetic coil 6 is assembled. The electromagnetic coil 6 is covered by the yoke 3, a resin cover 23 and a part of nozzle body 5 while keeping sealing property.

Inside the nozzle body 5, the movable body 4 is assembled so as to permit movement in the axial direction. At the tip end of the nozzle body 5, an orifice plate 7 forming a part of the nozzle body 5 is fixed by welding. The orifice plate 7 includes orifices 71~76 of multi holes to be served as the injection holes (nozzle holes) which will be explained later, and a circular cone face 7A including a valve seat portion 7B.

Inside the stationary core 2, a spring 8 that pushes the movable body 4 to the valve sheet, an adjuster for adjusting the spring force of the spring 8 and a filter 10 are assembled.

Inside the nozzle body 5, guide members 11 and 12 for guiding the movement of the movable body 4 in the axial direction is provided at the upper and lower positions thereof. The guide member 12 is disposed between a step portion 21 provided on the inner circumference at the tip end side of the nozzle body 5 and the orifice plate 7 fixed at the tip end of the nozzle body 5.

Although as a valve body (a valve rod) 41 of the present embodiment, a tip end tapered needle type is shown, a valve body of a type provided with a ball at the tip end can be used.

A fuel passage in the injection valve is constituted by the inside of the stationary core 2, a plurality of holes 13 provided in the movable core 40, a plurality of holes 14 provided in the guide member 11, the inside of the nozzle body 5, a plurality of holes 15 provided in the guide member 12 and the circular cone face 7A including the valve seat portion 7B.

In the resin cover 23, a connector portion 23A for feeding an exciting current (a pulse current) to the electromagnetic coil 6 is provided, and a part of lead terminal 18 insulated by the resin cover 23 is positioned in the connector portion 23A.

When the electromagnetic coil 6 accommodated in the yoke 3 is excited by an external driving circuit (not shown) via the lead terminal 18, the movable body 4 is magnetically pulled toward the stationary core 2 side against the force by the spring 8 while forming the magnetic circuit with the stationary core 2, the yoke 3 and the movable core 4. At this moment, the valve body 41 is put into an open valve condition by moving away from the valve seat portion 7B and the fuel in the injection valve main body that is pressurized in advance (to more than 10 MPa) by an external high pressure pump (not shown) is injected via the multi injection holes 71~76.

When the excitation of the electromagnetic coil 6 is turned off, the valve body 41 is pushed to the side of the valve seat 7B through the force of the spring 8 and is put into a closed valve condition.

Now, a structure of the orifice plate 7 and the multi injection holes (orifices) 71~76 forming a part of the nozzle member will be explained.

Figure 2:
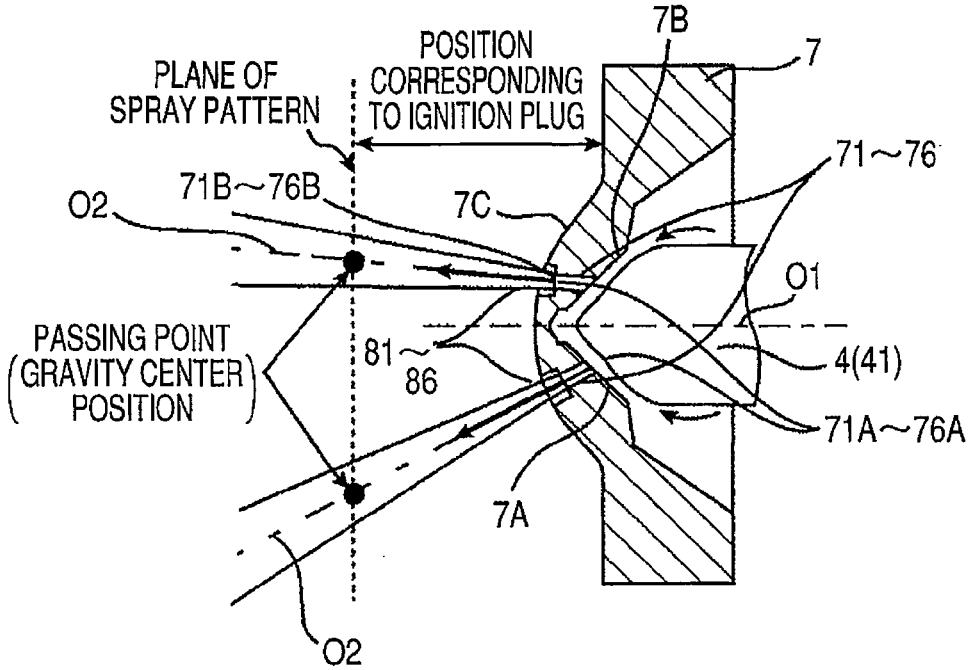
FIG. 2 is a longitudinal sectioned view showing near around an orifice plate in an injection valve main body.
Figure 3:
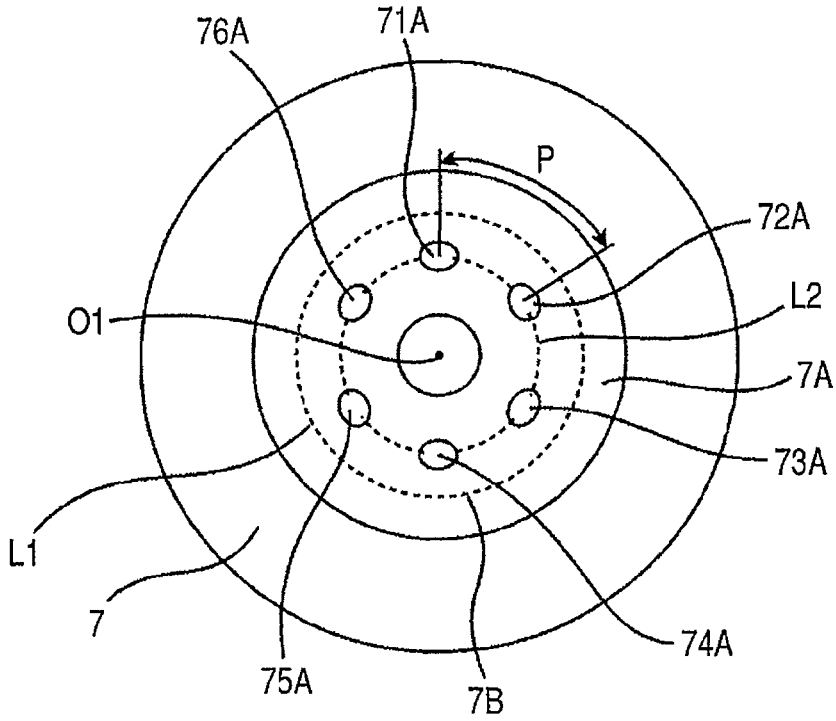
FIG. 3 is a plane view of the inside of the orifice plate seen from the axial direction of the injection valve main body.
Figure 4:
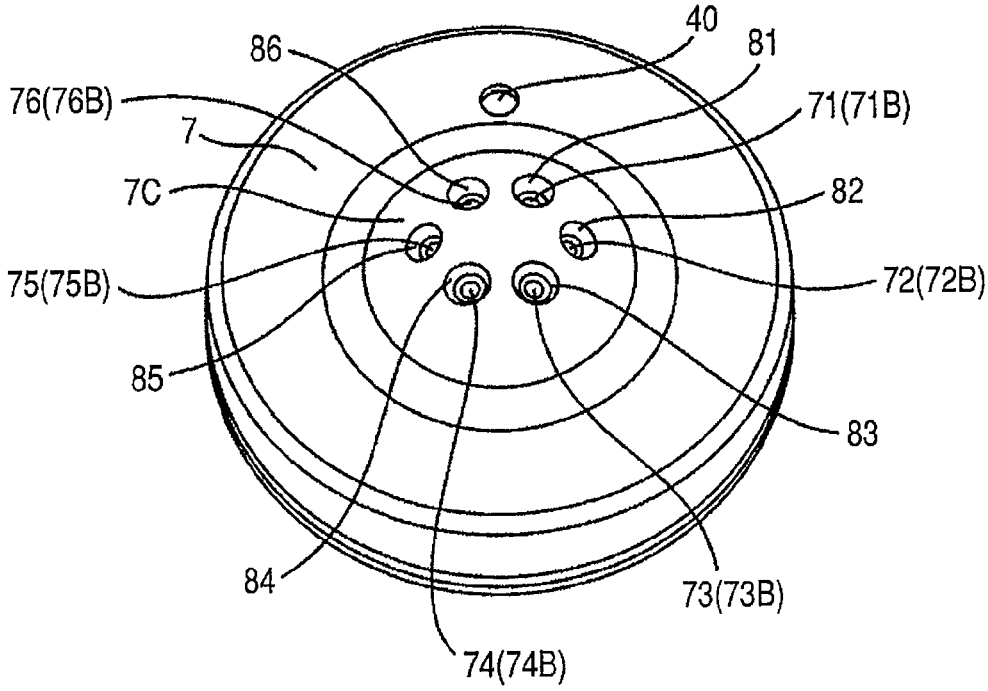
FIG. 4 is a perspective view showing the orifice plate as an item.

FIG. 2 is a longitudinal sectioned view showing near around the orifice plate 7 in the injection valve main body, and FIG. 3 is a plane view of the inside thereof seen from the axial direction of the injection valve main body. FIG. 4 is a perspective view showing the orifice plate 7 as an item.

On the tip end outer face of the orifice plate "nozzle member" 7, a spherical and convex shaped curved portion 7C is formed and on the inner face opposite from the convex shaped curved face portion 7C, the circular cone shaped concave face 7A including the valve seat portion 7B is formed. In the orifice plate 7, the multi hole orifices (injection holes) 71~76 are provided. The number of the multi hole orifices can be set at any number, however, in the present embodiment, six pieces of orifices 71, 72, 73, 74, 75 and 76 are provided. Inlets 71A~76A of the orifices 71~76 are arranged on the circular cone shaped concave face 7A at positions downstream a seat line L1 of the valve seat 7B and on a common circumferential line (an injection hole reference pitch circle) L2 around the center line O1 of the injection valve main body with an equal interval.

At the side of the convex shaped curved face portion 7C, concave portions 81, 82, 83, 84, 85 and 86 are provided each with a circular opening having a center line coincident or substantially coincident with center line O2 of the orifices 71~76.

The diameter of the concave portions 81~86 is larger than that of the orifices 71~76, and each bottom of the concaves 81~86 forms a face perpendicular or substantially perpendicular with respect to the orifice center line O2 and the concave portions center line. Outlets 71B~76B of the orifices 71~76 open to the bottom faces of the concave portions 81~86. Namely, the outlets 71B~76 are arranged at the side of the convex shaped curved face portion 7C.

An orifice length is a factor to determine a length of penetration of the injected fuel spray. Through properly changing the depth of the concave portions 81~86, the length of the orifices 71~76 can be set optimum without varying the thickness of the orifice plate 7, the spray configuration of the injected fuel is optimized and the processing of the orifices can be made easy. Further, since the thickness of the orifice plate 7 needs not to be varied depending on the length of the orifices, the stiffness of the orifice plate 7 can be maintained. Thereby, the orifice plate 7 of such structure is suitable for an injection valve for a high fuel pressure type of a higher pressure more than 10 MPa.

The depth of the concave portions 81~86 is different for every orifices 71~76, therefore, the orifice length thereof differs accordingly. Further, among these orifices, inclined angles of the adjacent orifices, in that an inclined angle (an angle formed between the respective orifice center line O2 and the injection valve main body center line O1) of the orifice with respect to the center line O1 of the injection valve main body is also different. Orienting direction of the respective orifices varies in variety of ways depending on the engine specification, for example, under an amounting state of fuel injection valves in an engine, ones are set to direct to around an ignition plug (not shown), a part of the remaining ones is set to direct to the crown face side of a piston (not shown) and a part of further remaining ones is set to direct to an intermediate position between the ignition plug and the piston. Accordingly, the outlets 71B~76B of the orifices 71~76 are not arranged on a common circular pitch as in the inlets 71A~76A as well as not arranged with an equal interval.

Figure 5:
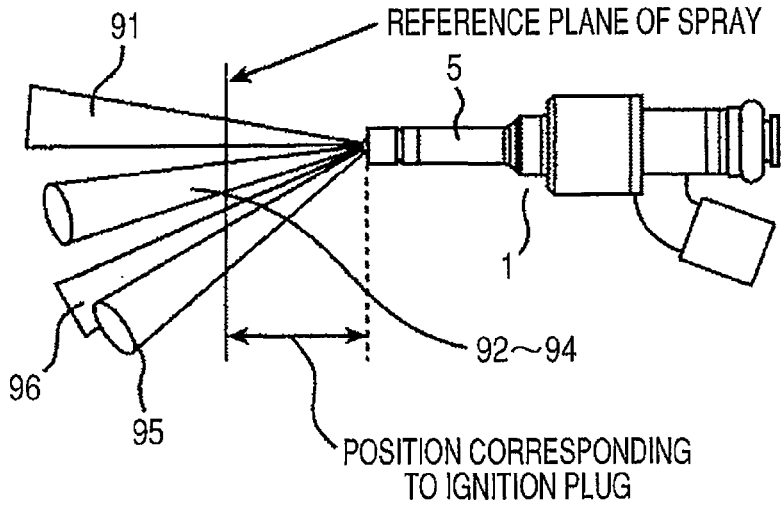
FIG. 5 shows an example configuration of multi hole sprays injected from an injection valve.
Figure 6:
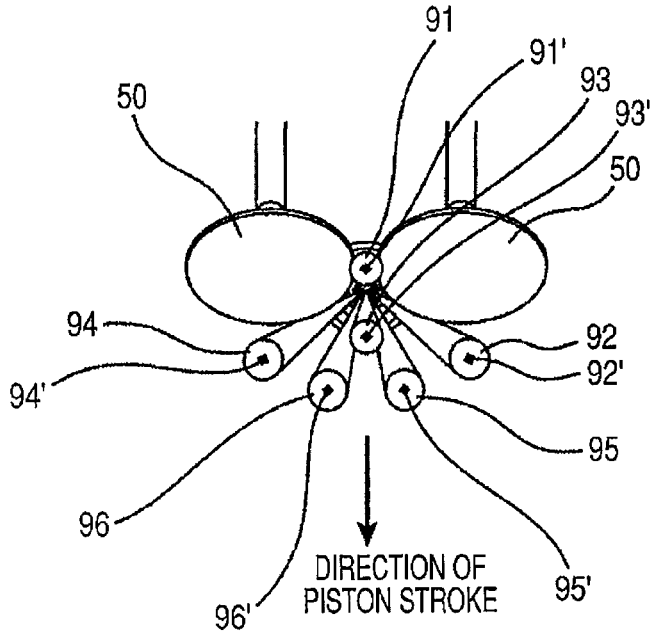
FIG. 6 shows a cross section of the sprays including a positional relationship with a suction valve (twin valve) of a cylinder.

FIG. 5 shows an example configuration of multi hole sprays 91~96 injected from an injection valve, and FIG. 6 shows a view of the above multi hole sprays 91~96 seen from a position away from the tip end of the nozzle by 40 mm and opposing to the injection valve. FIG. 6 shows a cross section of the sprays 91~96 including a positional relationship with a suction valve (twin valve) 50 of the cylinder while assuming an in-cylinder injection. The fuel sprays are set to be injected toward the target positions without being interfered with the suction valve 50 (the details of which will be explained later). Numerals 91'~96' show respective positions of center of gravity of the fuel sprays.

The fuel spray pattern as shown in FIGS. 5 and 6, is a spray pattern that realizes an injection in broad area by directing the spray location in multiple directions as well as that enhances the uniformity of the air fuel mixture in the combustion chamber by decreasing a deposition rate of the fuel spray on the valve.

The multi injection holes 71~76 respectively possess an inclination angle θ with respect to the center line O1 of the injection valve main body, and the respective inclination angle θ is provided with a predetermined offset amount in such a manner to increase the inclination angle more than the angle of the target direction of the center of gravity position 91'~96' of the injected fuel sprays 91~96. The predetermined offset amount is set based on a correction value for correcting a positional drift with respect to the target direction of the center of gravity positions 91'~96' of the injected fuel sprays 91~96. Herein below, the setting of the predetermined offset amount will be explained.

For setting the offset amount, it is necessary to confirm the center of gravity position of the injected fuel sprays. As the methods therefor, a variety of methods are also studied in SAE-J2715, however, until now, no standard confirmation method is established. Herein, a method of determining gravity center position with brightness is used in which a cross sectioned image of a spray is taken, the density of the spray is converted into brightness information and through image processing the converted brightness information the center of gravity position of the spray is determined.

Figure 7:
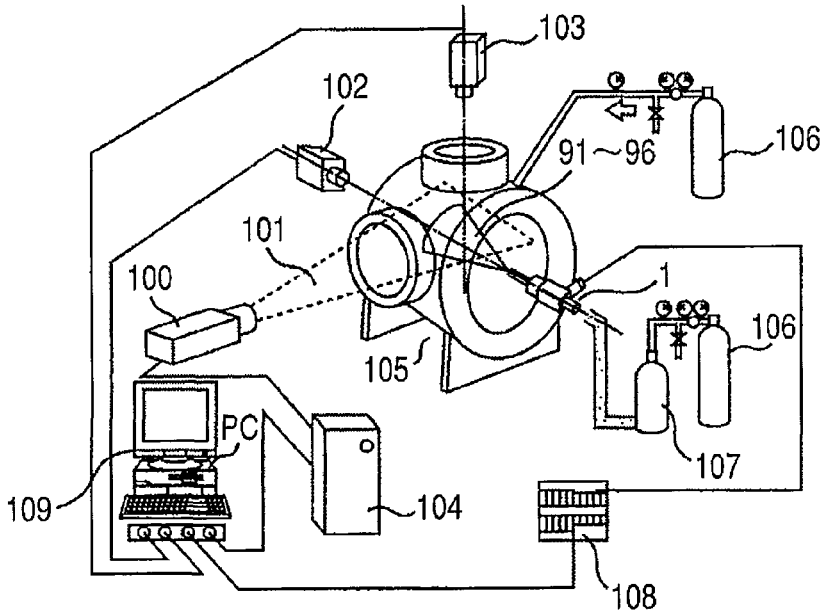
FIG. 7 is a view showing a state when taking a cross sectioned image of multi hole sprays by making use of an image taking device.

At first, by making use of an image taking device as shown in FIG. 7, a cross sectioned image of sprays is taken.

In FIG. 7, numeral 100 is a laser device, 101 a laser sheet emitted from the laser device 100, 102 and 103 CCD cameras disposed each other in an orthogonal relationship, 104 a laser driving circuit, 105 a pressure chamber serving as a space for fuel injection, 106 a nitrogen gas tank, 107 a fuel tank, 108 an injection valve driving circuit, and 109 a personal computer for controlling all of the machines and devices in the present measurement apparatus.

With the present image taking device, a fuel spray is irradiated by the laser sheet 101 that is perpendicular to the injection direction and the cross sectioned image of the fuel spray can be recorded by the CCD cameras 102 and 103. By shifting the position of the laser sheet 101 a cross sectioned image at any positions from the nozzle tip end can be taken principally, however, in the present example, a cross sectioned image on a plane (reference plane) corresponding to the position of an ignition plug was used. Light emitting time of the laser is adjusted by controlling a lapsed time (Td) from an injection pulse so that a cross section of a fuel spray at any timing can be taken.

Figure 8:
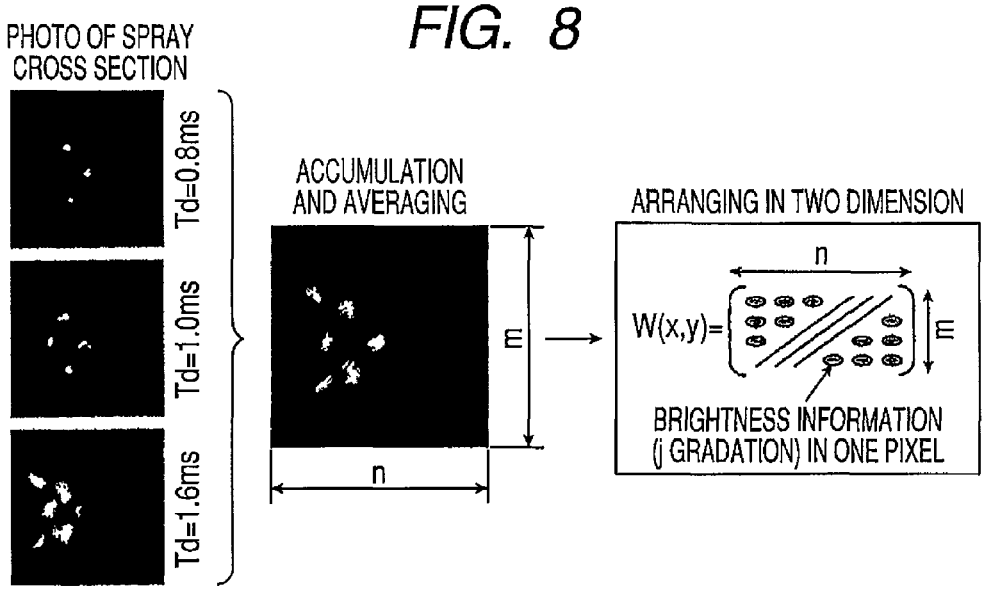
FIG. 8 an explanatory diagram showing a method of obtaining the cross sectioned images of the above multi hole sprays.

With regard to the fuel spray from a multi hole injection type valve, since the injection direction spreads in three dimensional manner, the distance to the laser sheet from respective fuel sprays is not uniform and all of the fuel sprays do not necessarily reach the laser sheet at the same time. Therefore, as shown in FIG. 8, a few images are taken while changing the laser emitting time (Td) and thereafter by accumulating and averaging these images all of the fuel sprays can be collected into a single cross sectioned image.

Figure 9:
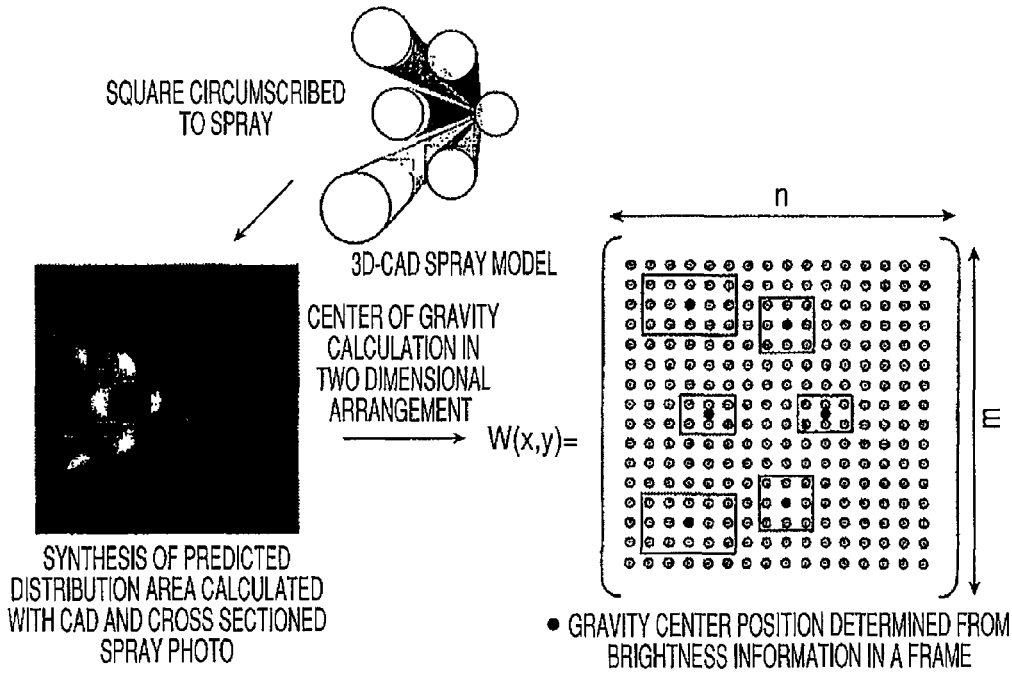
FIG. 9 an explanatory diagram showing a method of determining gravity center positions of the above multi hole sprays.

The single image file is converted into two dimensionally arranged information w (x, y) of brightness. This series of flow is as that shown in FIG. 9. Further, as shown in FIG. 9, a predicted distribution area of the respective fuel sprays on the fuel spray pattern plane is calculated with 3D-CAD and the gravity center positions of the respective sprays are determined from the brightness information within the area. The gravity center positions are calculated according to the following equations. In the equations, n is the calculation range determined by 3D-CAD.

[Mathematical formulas 1]

$$xg = \frac{\sum_n wixi}{\sum_n wi}$$

$$yg = \frac{\sum_n wiyi}{\sum_n wi}$$

Figure 10:
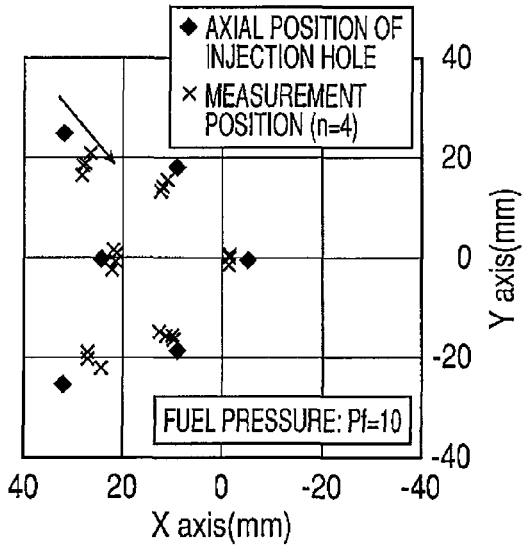
FIG. 10 is a diagram showing results measured by the above method of spray gravity center positions with regard to a prototype injection valve in which the injection hole pattern (inclination angle) was set in pattern A.
Figure 11:
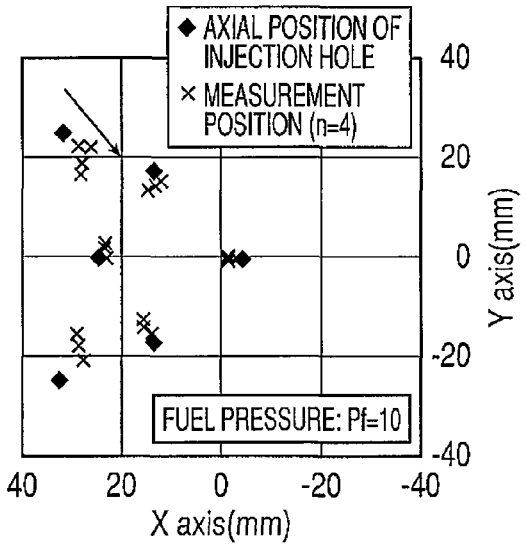
FIG. 11 is a diagram showing results measured by the above method of spray gravity center positions with regard to a prototype injection valve in which the injection hole pattern (inclination angle) was set in pattern B.
Figure 12:
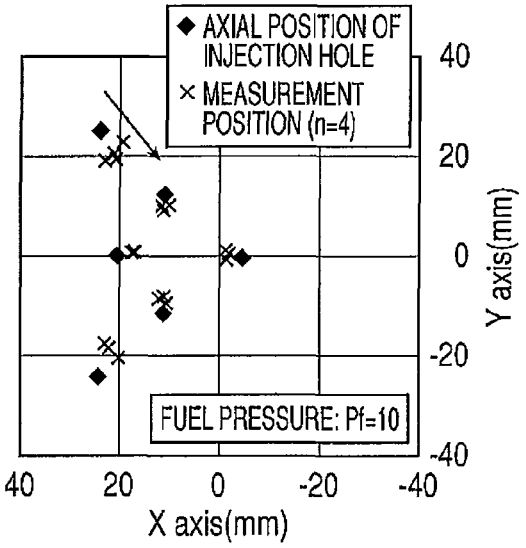
FIG. 12 is a diagram showing results measured by the above method of spray gravity center positions with regard to a prototype injection valve in which the injection hole pattern (inclination angle) was set in pattern C.

FIGS. 10, 11 and 12 show measurement results with the above method of spray gravity center positions of prototype injection valves in which the injection hole patterns (inclination angle) were set in three patterns. When observing these results, in all of the three patterns, all of the actual fuel spray gravity center positions tend to be pulled toward the center side of the injection valves (herein after will be called as "drift inward") with respect to the target (designed) fuel spray patterns. Namely, it was clarified that actually the multi hole type fuel spray does not fly in parallel with the axial direction of the injection valve.

In order to clarify, verify and resolve this phenomenon, the causes thereof were analyzed by making use of FTA, which is one of methods of QFD. As a result of FTA, the following two phenomena were enumerated as main causes thereof.

(a) Influence Due to Inclination Angle of Injection Hole

The angle formed by a direction of flow throttled by the movable valve body 41 and the axial line (center line) of the injection hole varies in a rage of 45°~90°. Accordingly, because the flow of fuel sometimes varies sharply at the inlet of the injection hole, and since the flow within the injection hole is affected by the original flow and tends to flow inward, the gravity center position of a spray is caused to shift to the center side of the injection valve.

(b) Influence Due to Air Flow Near the Outlet of Injection Hole

Particles of fuel injected from an injection hole move in the injection direction while entraining air contacting around there. Therefore, air around the spray begins to move. On one hand, since the spray is concentrated near the outlet of the injection hole, and the inside of the spray is placed under a condition near to a closed space, a difference in air density is caused between the outside and inside of the spray. As the result, a pressure difference between the outside and inside of the spray is caused, and the air flows from air dense side to air sparse side through the spray. At this moment, the spray is forced to inward direction due to the effect of this air flow. Accordingly, the air flow near the outlet of the injection hole causes to shift the gravity center position of the spray inward. Namely, such a fuel injection pattern is formed in which the fuel sprays in multi directions injected from multi injection holes surround the center axis line of the injection valve main body and the inside pressure surrounded by the fuel sprays is rendered smaller than that of the outside of the fuel spray configuration to cause the pressure difference.

Accordingly, when an injection hole is designed only under a condition "an inclination angle=a target direction of spray", the actual gravity center position of the spray drifts from a defined position (target direction) representing the target. Therefore, a correction has to be performed when forming the injection hole so that the gravity center position of a spray assumes the defined position.

Figure 13:
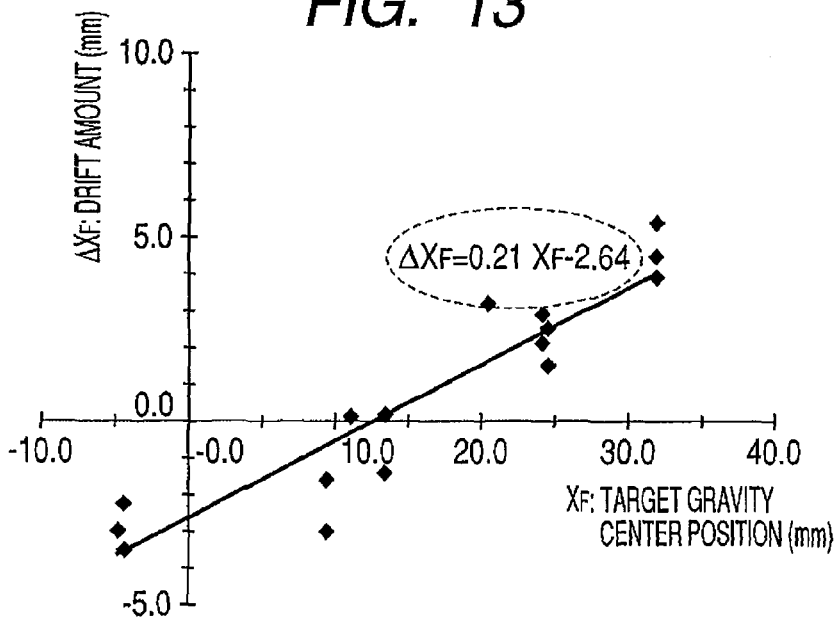
FIG. 13 shows a relationship of drift amount in X direction between defined gravity center positions of multi hole sprays and measured gravity center positions of the spray.
Figure 14:
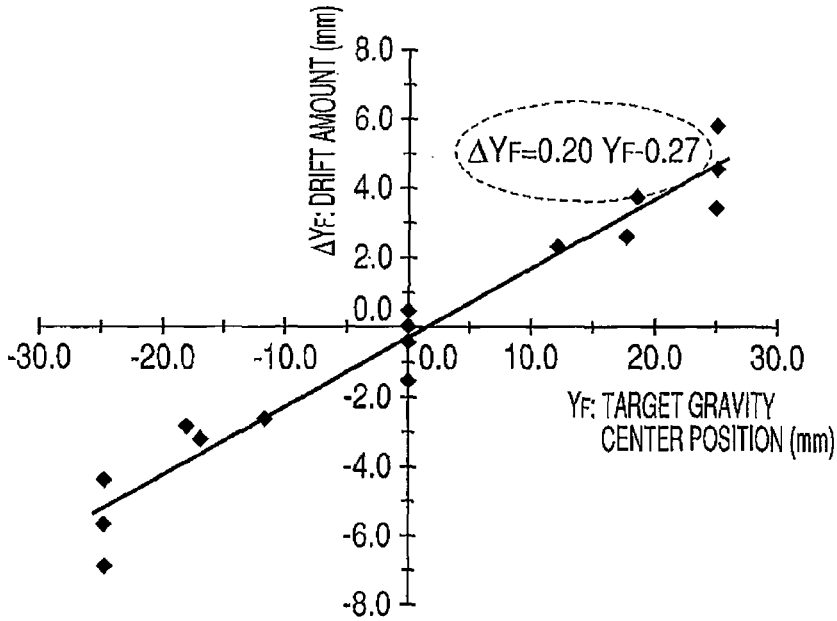
FIG. 14 shows a relationship of drift amount in Y direction between defined gravity center positions of multi hole sprays and measured gravity center positions of the spray.

FIG. 13 shows a relationship of drift amount in X direction between defined gravity center positions of multi hole sprays and measured gravity center positions of the spray. FIG. 14 shows a relationship of drift amount in Y direction between defined gravity center positions of multi hole sprays and measured gravity center positions of the spray. From the relationship of the drift amount from the defined gravity center position, linearly approximated correction equations are determined and then a correction is effected to the injection hole according to the equations. When assuming the axial line of the injection valve main body on a two dimensional coordinate as the reference coordinate (0, 0) and when assuming the gravity center position (gravity center position of the defined position) in the target direction of the fuel spray injected from each of injection holes on the two dimensional coordinate as ($X_F$, $Y_F$) and the positional drift of the fuel spray as ($\Delta X_F$, $\Delta Y_F$), the following linearly approximated correction equations stand.

$$X_F'=X_F+\Delta X_F=X_F+(0.21\Delta X_F-2.64)$$

$$Y_F'=Y_F+\Delta Y_F=Y_F+(0.20\Delta Y_F-0.27)$$

In the present embodiment, after the inclination angle of the injection hole is corrected so that the center lines of the injection hole (orifices 71~76) and the concave portion (81~86) coincide with these $X_F'$ and $Y_F'$, the injection holes are formed.

Figure 15:
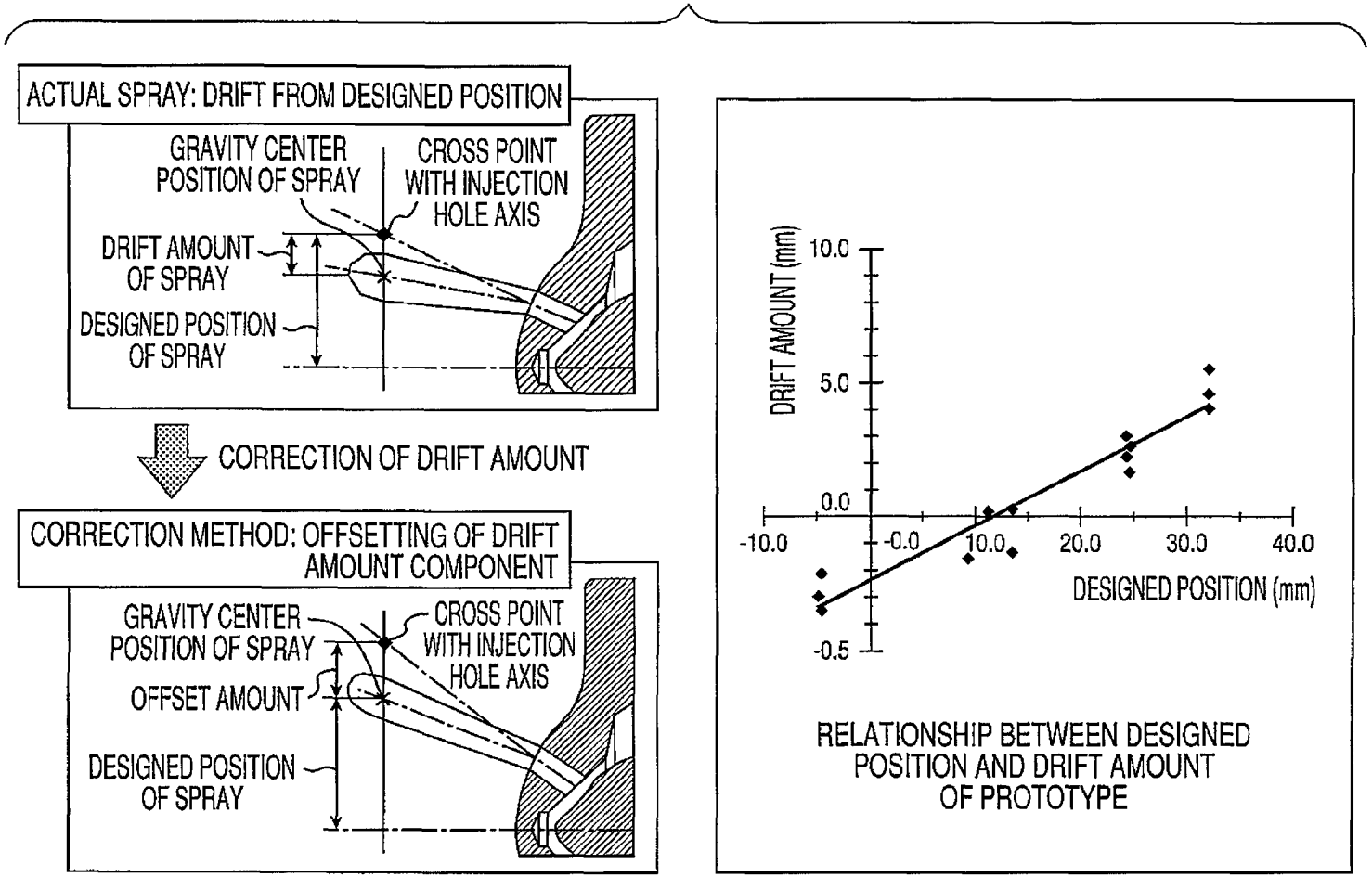
FIG. 15 shows a schematic diagram for explaining a relationship between a designed position of a spray injected from an injection hole and a drift amount and a correction performed by setting an offset amount based on the relationship.

FIG. 15 shows a schematic diagram for explaining the above relationship between the designed position of a spray and the drift amount and a correction performed by setting an offset amount based on the relationship. Through calculating the offset amount of the injection hole according to the above linearly approximated equations and feeding back the same, the above drift component of the fuel spray can be canceled out, and thereby, the designed gravity center position of the spray and the actual gravity center position of the spray can be substantially coincided.

The forming of the injection hole is performed in the following process. At first, a blank to be processed to the orifice plate 7 is fixed. On the blank the convex shaped curved face portion 7C is formed in advance by cutting or press working. Through a press working of the blank, the concave portion 81 is extruded in a bag shaped hole by punching from the side of the convex shaped curved face portion 7C. Thereafter, by making use of a punch for forming the orifice 71, a bag shaped hole to be served as the orifice 71 is extruded from the side of the bottom face of the concave portion 81 and in perpendicular thereto. At the time of forming the concave portion 81 and the orifice 71, the press working is performed so that the inclination angle is provided with the correction amount. Thereafter, by forming the circular cone face 7A including the valve seat 7B with a cutting work on the face opposite from the face subjected to the above extrusion work of the blank, the orifice 71 at the same time opens. The remaining concave portions 82~86 and orifices 71 76 are formed likely. Further, since this forming process itself is well known, detailed explanation thereof is omitted.

Figure 16:
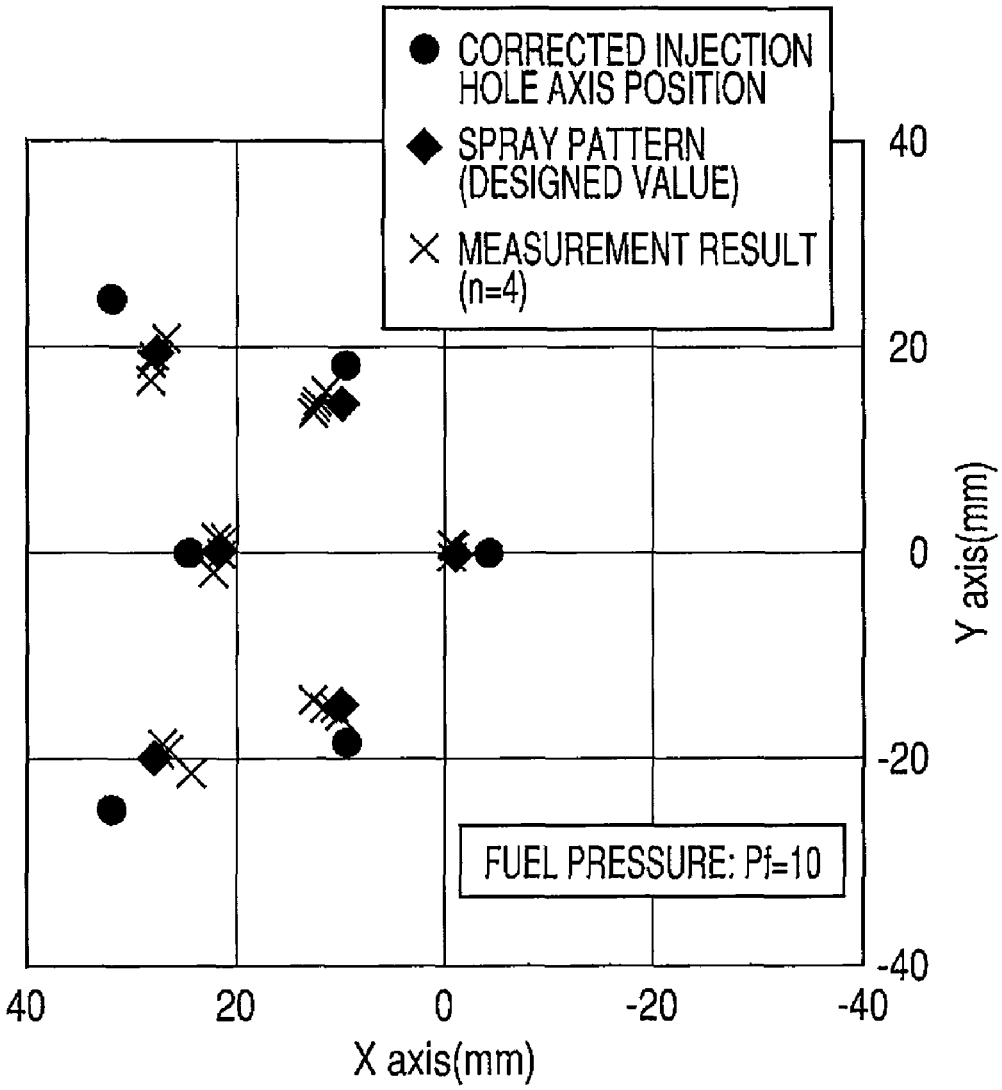
FIG. 16 is a diagram showing a measured result of the gravity center positions of the injection holes formed by making use of the correction method according to the present embodiment.

FIG. 16 shows a measured result of the gravity center positions of the injection holes formed by making use of this correction method. From this result, it was confirmed that since the gravity center position of the spray injected from the corrected injection hole is on a spray pattern of the target direction (defined position), the present correction is effective.

According to the present embodiment, with the multi injection holes having the predetermined offset amount, fuel can be injected to a targeted optimum position that contributes to enhance such as the engine performance and the exhaust performance.

What is claimed is:

1. A multi hole injection type fuel injection valve for an internal combustion engine having multi injection holes that inject fuel in multiple directions, inlets of the multi injection holes being arranged on a common circumferential line around a center line of an injection valve main body so a space surrounded by the fuel sprays injected from the multi injection holes is formed so that air flows between adjacent fuel sprays from outside to inside of the space surrounded by the fuel sprays, wherein each of the multi injection holes has an inclination angle with respect to a center line of the injection valve main body as well as the inclination angle of each of the injection holes and is provided with a predetermined offset amount so that a center of gravity position of each of the fuel sprays injected from the multi injection holes is oriented in a target direction, the center of gravity position of each of the fuel sprays is obtained by the amount of each of the fuel sprays injected onto a plane corresponding to a position of an ignition plug, and the predetermined offset amount is set based on a correction amount for correcting positional drift with respect to the target direction of the center of gravity position of the fuel spray.

2. A multi hole injection type fuel injection valve according to claim 1, wherein a fuel spray pattern formed by the fuel sprays in the multiple directions injected from the multi injection holes surrounding the center line of the injection valve main body causes such a pressure difference that a pressure inside of the space surrounded by the fuel sprays is lower than that outside.

3. A multi hole injection type fuel injection valve according to claim 1, wherein the fuel injection valve includes a nozzle member in which at the tip end thereof a convex shaped curved portion is formed and on an inner face of the opposite side thereof a circular cone shaped concave face having a valve seat is formed, the nozzle member is provided with the multi injection holes being given the predetermined offset amount, inlets of the respective injection holes are arranged on the circular cone shaped concave face and on a common circumferential line around the center line of the injection valve main body, and the outlets thereof are arranged on the convex shaped curved portion.

4. A multi hole injection type fuel injection valve according to claim 1, wherein when assuming the axial line of the injection valve main body on a two dimensional coordinate of the plane corresponding to the position of the ignition plug as the reference coordinate (0, 0) and when assuming the gravity center position in the target direction of fuel spray injected from each of injection holes on the two dimensional coordinate as ($X_F$, $Y_F$) of the plane corresponding to the position of the ignition plug, and the positional drift of the fuel spray as ($\Delta X_F$, $\Delta Y_F$), a corrected gravity center position of each of the multi injection holes on the two dimensional coordinate ($X_F'$, $Y_F'$) is set based on the following linearly approximated equations:

$X_F' = X_F + \Delta X_F$, and $Y_F' = Y_F + \Delta Y_F$.

5. A multi hole injection type fuel injection valve according to claim 1, wherein each of the multi injection holes has an inclination angle of 5°~50° with respect to the center axis of the injection valve main body.

6. A multi hole injection type fuel injection valve according to claim 1, wherein the multi hole injection type fuel injection valve is for an in-cylinder injection type internal combustion engine that directly injects fuel sprays into the cylinder of the internal combustion engine.

* * * * *